US007200356B2

(12) United States Patent
Kawamoto

(10) Patent No.: US 7,200,356 B2
(45) Date of Patent: Apr. 3, 2007

(54) DISCHARGE ROLLER DEVICE

(75) Inventor: Makoto Kawamoto, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 209 days.

(21) Appl. No.: 11/049,189

(22) Filed: Feb. 2, 2005

(65) Prior Publication Data

US 2005/0220520 A1 Oct. 6, 2005

(30) Foreign Application Priority Data

Mar. 1, 2004 (JP) ..... 2004-055997

(51) Int. Cl.
*G03G 15/00* (2006.01)

(52) U.S. Cl. ..... 399/405; 399/406; 271/188; 271/207; 271/274; 271/314; 271/272; 271/273; 271/209

(58) Field of Classification Search ..... 399/405, 399/406; 271/188, 207, 274, 314, 272, 273
See application file for complete search history.

(56) References Cited

U.S. PATENT DOCUMENTS

| | | | | | |
|---|---|---|---|---|---|
| 3,545,371 | A | * | 12/1970 | Reist | 100/176 |
| 4,089,378 | A | * | 5/1978 | Suzuki | 169/54 |
| 4,214,740 | A | * | 7/1980 | Acquaviva | 271/3.2 |
| 4,359,217 | A | * | 11/1982 | Roller et al. | 271/186 |
| 4,964,627 | A | * | 10/1990 | Watts et al. | 271/188 |
| 5,094,660 | A | * | 3/1992 | Okuzawa | 493/320 |
| 5,209,466 | A | * | 5/1993 | Watts et al. | 271/188 |
| 5,653,439 | A | * | 8/1997 | Rider et al. | 271/274 |
| 5,870,662 | A | * | 2/1999 | Tomatsu | 399/406 |
| 5,927,709 | A | * | 7/1999 | Greive | 271/188 |
| 6,089,567 | A | * | 7/2000 | Yatsuhashi et al. | 271/314 |
| 2003/0007817 | A1 | * | 1/2003 | Saitoh | 399/406 |

FOREIGN PATENT DOCUMENTS

| | | |
|---|---|---|
| JP | 53-142235 | 12/1978 |
| JP | 06-127776 | 5/1994 |
| JP | 09-188459 | 7/1997 |
| JP | 2003-076182 | 3/2003 |

* cited by examiner

*Primary Examiner*—Ren Yan
*Assistant Examiner*—Matthew Marini
(74) *Attorney, Agent, or Firm*—Hogan & Hartson LLP

(57) ABSTRACT

A discharge roller device includes at least one roller pair, at least one first free roller and at least one second free roller. The roller pair includes a driving roller and a pressure roller pushed against the driving roller. The first free roller is disposed at a side where the driving roller is disposed with respect to a plane including a nip part of the roller pair and a part of the first free roller is located in the pressure roller side rather than the plane. The second free roller is disposed at a side where the pressure roller is disposed with respect to the plane and a part of the second free roller is located in the driving roller side rather than the plane.

20 Claims, 3 Drawing Sheets

DISCHARGE ROLLER DEVICE

BACKGROUND OF THE INVENTION

1. Field of the Invention

The present invention relates to a discharge roller device which is disposed downstream of a fixing device in a paper transportation path of an image forming device.

2. Description of Related Art

A general fixing device includes a heat roller and a pressure roller which is pressed against the heat roller. When paper carrying a toner passes through a nip part between the heat roller and the pressure roller, the toner is heated and pressurized and the toner is fixed onto the paper. In such a fixing device, since the heat roller includes a heat source, the heat roller is maintained at a higher temperature than the pressure roller. Therefore, the paper that passed through the nip part is dewatered more on a surface of a side making contact with the heat roller than a surface of a side making contact with the pressure roller. Due to the difference in the dewatered amounts, fibers on the heat roller side shrink more than fibers on the pressure roller side. As a result, the paper curls.

A conventional discharge roller device discharges paper that passed through a fixing device to the exterior of an image forming device while correcting a curled direction of the paper. The conventional discharge roller device includes a mechanism which sags the paper in a width direction during the transportation of the paper. This mechanism is disposed downstream of the fixing device in the paper transportation path. Specifically, the conventional discharge roller device includes one roller pair or a plurality of roller pairs. In one of the rollers of a pair of rollers, a flange and a roller body are formed integrally. The flange sags the paper in the width direction. As described above, paper that has passed through the fixing device is discharged while the curl has been corrected.

A nip width is preferable to be wide for reliably discharging the paper. Therefore, at least one roller of the pair of rollers is a rubber roller having an elastic body. If a roller for driving (a driving roller) is formed as a rubber roller, the contact area of the driving roller and the paper at the nip part increases. Thus, the driving roller is preferable to be formed as a rubber roller.

In case a flange is provided on the driving roller, the flange strongly makes contact with the paper. If a sagged amount of the paper is excessive, there are cases in which a fold line is formed on the discharged paper. Therefore, there is a demand for the flange to sag easier than a contact portion of the pressure roller. In response to such a demand, in a conventional discharge roller device, a center part of a flange is hollow. However, the shape of the integrally formed rubber roller becomes complicated, and the length of the heat roller in the axial direction increases by the length of the flange. As a result, the manufacturing cost of the driving roller increases.

However, according to the present invention, without complicating the shape of the driving roller, the curl of the paper that has passed through the fixing device can be corrected.

SUMMARY OF THE INVENTION

An aspect of the present invention relates to a discharge roller device disposed downstream of a fixing device of a heat roller in a paper transportation path in an image forming device. In the discharge roller device of the present invention, one roller pair includes a driving roller and a pressure roller, and a plurality of roller pairs are arranged in a width direction of paper. At both sides of a plane including nip parts of the roller pairs, a plurality of free rollers protruding from the plane are arranged in the width direction.

Accordingly, even when paper curls in a transportation direction by the fixing device, the discharge roller device ripples the paper in the width direction and corrects the paper. Therefore, the paper that passed through the discharge roller device does not curl.

According to another aspect of the present invention, for each driving roller, on a driving shaft of the driving roller and at both sides of the driving roller in an axial direction, drive side free rollers as free rollers at one side are disposed.

Accordingly, the length of the driving roller in the axial direction is not required to be lengthened and a number of roller pairs can be reduced.

According to another aspect of the present invention, the stiffness of the drive side free rollers is smaller than the stiffness of the driving roller.

Accordingly, the drive side free rollers are sagged by the transported paper. As a result, a fold line is not formed on the paper. Compared with the conventional discharge roller device in which the driving roller and the flange are integrally formed, both the driving roller and the drive side free rollers can be made economically.

DETAILED DESCRIPTION OF THE INVENTION

An embodiment of the present invention will be described in detail. Further, the embodiment to be described below is a preferable specific example for implementing the present invention. Therefore, there are various technical limitations in the description. However, unless explicitly stated in the following description to limit the present invention, the present invention shall not be limited to the embodiment.

Figure 1:
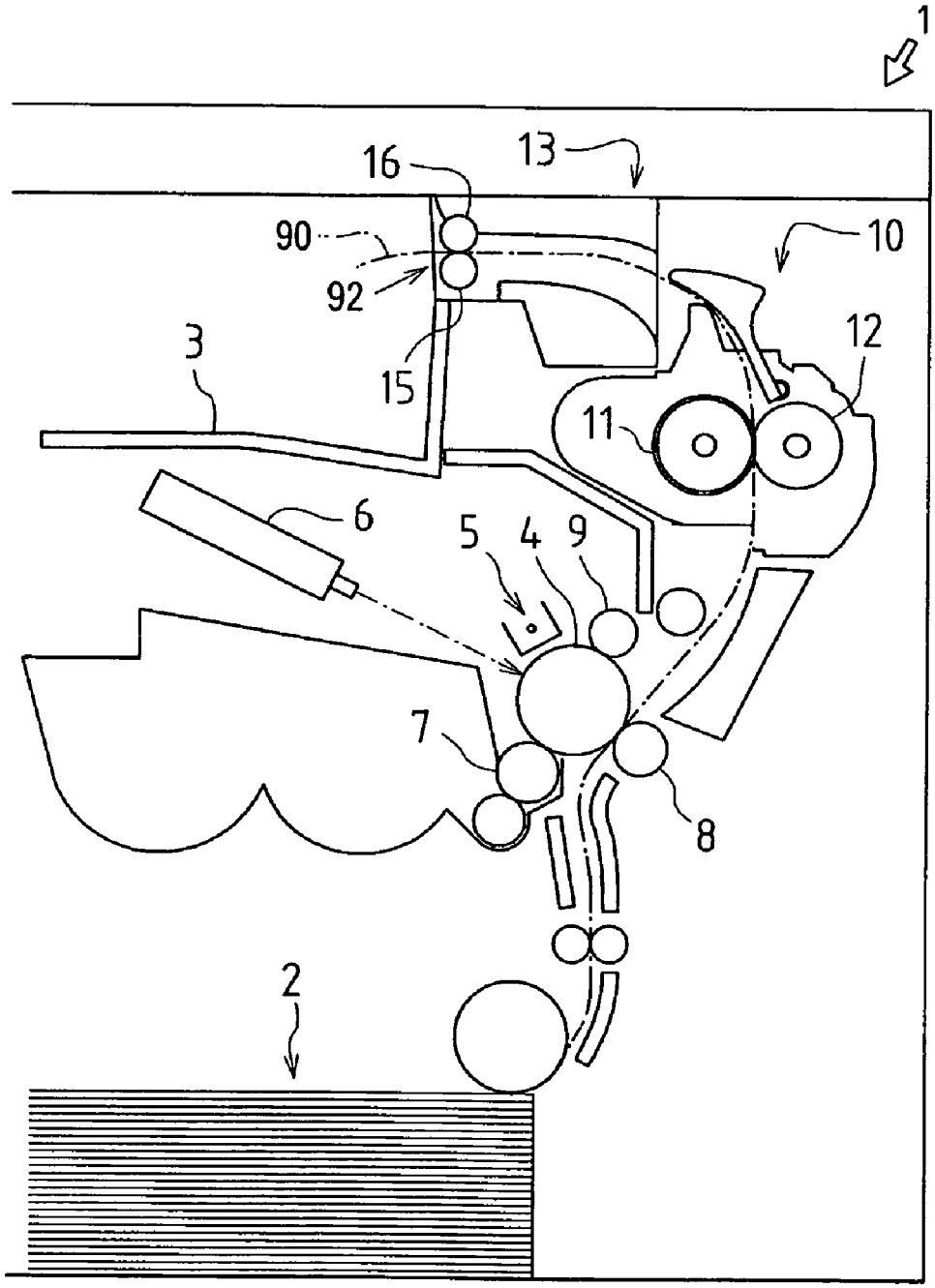
FIG. 1 is a transverse sectional view showing a structure of various process devices in a printer.

As shown in FIG. 1, an image forming device 1 includes a discharge roller device 13 according to an embodiment of the present invention. The image forming device 1 includes an image forming unit which forms a toner image by an electrophotographic process onto paper transported through a paper transportation path 90. The image forming device 1 includes a charging device 5, an exposing device 6, a developing device 7, a transfer device 8, a cleaning device 9 and a fixing device 10. These devices are provided along the paper transportation path 90 from a paper feeding device 2 to a paper discharge tray 3. Further, the paper feeding device 2 accommodates papers.

Specifically, a photoconductive drum 4 is disposed downstream of the paper feeding device 2 in the paper transportation path 90. The charging device 5, the exposing device 6, the developing device 7, the transfer device 8 and the cleaning device 9 are disposed around the photoconductive drum 4. The charging device 5 charges the photoconductive drum 4. A laser scanning device, which is the exposing device 6, irradiates light onto the photoconductive drum 4 and an electrostatic latent image is formed on the photoconductive drum 4. A toner is supplied to the electrostatic latent image from a developing roller as the developing device 7 and a toner image is formed on the photoconductive drum 4. The toner image is transferred onto paper by a transfer roller as the transfer device 8. The toner remaining on the photoconductive drum 4 after a transfer process is collected by an eraser brush as the cleaning device 9.

The fixing device 10 is disposed downstream of the photoconductive drum 4 in the paper transportation path 90. The fixing device 10 includes a heat roller 11 and a press roller 12. The heat roller 11 heats the paper on which the toner image is transferred. The press roller 12 pressurizes the paper. The fixing device 10 fixes the toner image onto the paper. A discharge roller device 13 is disposed downstream of the fixing device 10 in the paper transportation path 90. The discharge roller device 13 discharges onto the paper discharge tray 3, the paper that has passed through the fixing device 10.

Figure 2:
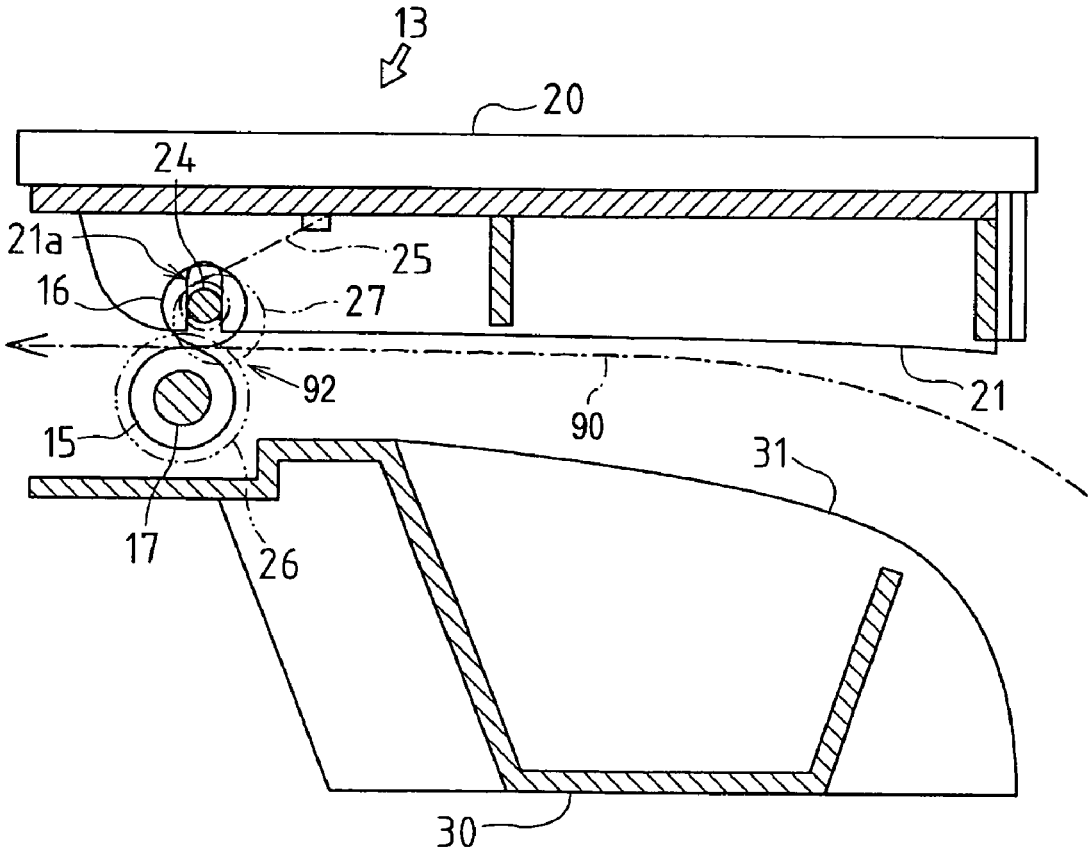
FIG. 2 shows a discharge roller device viewed from a width direction of paper.
Figure 3:
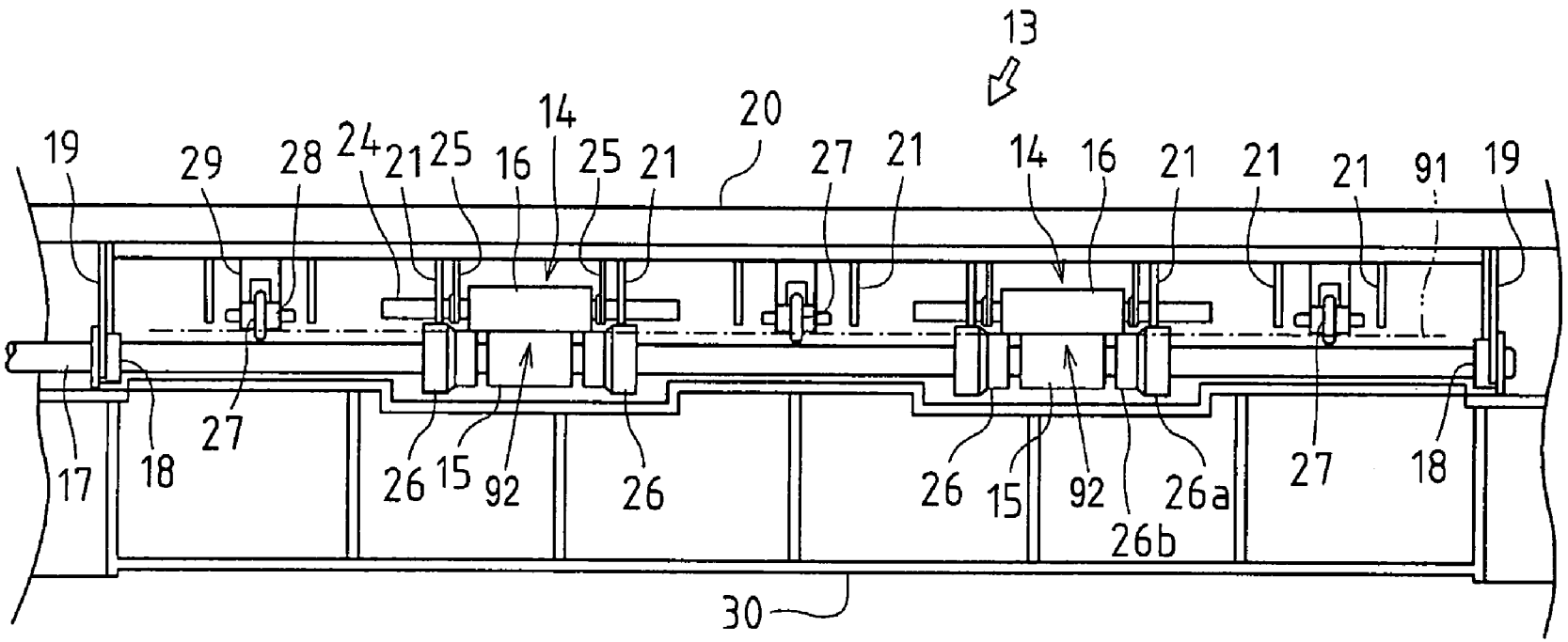
FIG. 3 shows the discharge roller device viewed from a discharge side of a paper transportation direction.

With reference to FIGS. 2 and 3, the discharge roller device 13 will be described in detail. In the discharge roller device 13, a plurality of (in the present embodiment, two) roller pairs 14 are provided along a width direction of the paper (in a direction orthogonal to the page of FIG. 2, in a horizontal direction of FIG. 3). The roller pairs 14 discharge the paper from the image forming device 1. Each of the roller pairs 14 includes a driving roller 15 and a pressure roller 16 which is pushed against the driving roller 15. The paper that passed through the fixing device 10 is nipped between the driving roller 15 and the pressure roller 16 and fed toward a downstream direction of the paper transportation path 90 by the rotation of the driving roller 15.

A frame of the discharge roller device 13 is formed of two frames 20 and 30. The frame 20 is disposed above the paper transportation path 90. The other frame 30 is disposed below the paper transportation path 90.

Paper guides 21 are formed on the upper first frame 20. The paper guides 21 extend downward toward the paper transportation path 90 (vertically downward). Paper guides 31 are formed on the lower second frame 30. The paper guides 31 extend upward toward the paper transportation path 90 (vertically upward). The paper guides 21 and 31 are respectively ribs and disposed with a prescribed interval spaced between one another in the width direction of the paper. As described above, by forming the paper guides 21 and 31 as ribs, the paper can be transported through the paper transportation path 90 under a state in which a contact area of the paper guides 21 and 31 and the paper is reduced as much as possible.

As shown in FIGS. 2 and 3, the driving roller 15 of each of the roller pairs 14 is a cylindrical body. The driving rollers 15 are fixed on one common driving shaft 17 with a prescribed interval spaced between one another in an axial direction. The driving shaft 17 is supported rotatably on the first frame 20. Specifically, on the driving shaft 17 extending in parallel with the width direction of the paper, bearings 18 are mounted at both sides of a fixed area of the plurality of roller pairs 14, respectively. The bearings 18 rotatably support the driving shaft 17. Each of the bearings 18 is respectively fixed on supporting plates 19 which extend downward toward the paper transportation path 90 from a bottom surface of the first frame 20 at both sides of the first frame 20. The driving shaft 17 and a drive source provided in the printer 1 are connected via a drive transmitting mechanism, and each of the driving rollers 15 rotates simultaneously by the rotation of the drive shaft 17.

As shown in FIGS. 2 and 3, each of the pressure rollers 16 is fixed on a supporting shaft 24 provided for each of the roller pairs 14. Different from the driving rollers 15, each of the pressure rollers 16 is supported on a different supporting shaft 24, respectively. Springs 25 are wound around both ends of the supporting shaft 24 and supported by the first frame 20. Accordingly, the pressure rollers 16 and the supporting shafts 24 are supported by the first frame 20. By an urging force of the springs 25, the pressure rollers 16 are pushed against the driving rollers 15. The following structure regulates the pressure rollers 16 to move only in a direction to approach and separate with respect to the driving rollers 15. Each of the pressure rollers 16 is disposed between two paper guides 21. A long hole 21*a* is formed through each of the paper guides 21 located at both sides of the pressure roller 16. The supporting shaft 24 is inserted through the long holes 21*a*. Each of the long holes 21*a* extends in a vertical direction and is open at the paper transportation path 90. The supporting shaft 24 is accommodated into the long hole 21*a* from an opened part. The supporting shaft 24 is movable in a direction in which the long hole 21*a* extends. By the above structure, the pressure roller 16 is movable only in a direction to approach or separate with respect to the driving roller 15. The pressure roller 16 is pushed against the driving roller 15 by the urging force of each of the springs 25.

As shown in FIG. 3, the paper fed toward a downstream side of the fixing device 10 enters into the discharge roller device 13. In the discharge roller device 13, the paper is fed into nip parts 92 (contact portions of the driving rollers 15 and the pressure rollers 16) of the plurality of roller pairs 14. Then, the paper is held by a frictional force of the driving rollers 15 and the pressure rollers 16. The paper is fed further to the downstream side by the rotation of the driving rollers 15.

The paper is held and fed by the nip parts 92 of the plurality of roller pairs 14 in the width direction of the paper. Here, suppose that a surface including a surface formed by the nip parts 92 of each of the roller pairs 14 is a paper transportation surface 91. The paper transportation surface 91 refers to a plane where the paper fed into the roller pairs 14 by the plurality of the roller pairs 14, excluding rollers to be described later, is transported. Further, the roller pairs 14 are arranged in the width direction of the paper with a prescribed interval spaced between one another. Therefore, an interval between the nip parts 92 of each of the roller pairs 14 is also spaced. Thus, the paper can be sagged with respect to the paper transportation surface 91 between the nip parts 92.

With reference to FIGS. 2 and 3, a mechanism for sagging the paper in the width direction, more specifically, a mechanism for rippling the paper in the width direction in the discharge roller device 13 will be described. In the discharge roller device 13, in addition to the plurality of roller pairs 14 for discharging the paper, a plurality of free rollers 26 and 27 for sagging the paper in the width direction are provided. The free rollers 26 and 27 are provided at both sides across the paper transportation surface 91. In particular, a free roller located below the paper transportation surface 91 and fixed on the same driving shaft as the driving roller 15 is a drive side free roller 26. A free roller located above the paper transportation surface 91 and located along side the pressure roller 16 is a driven side free roller 27.

The drive side free roller 26 is a cylindrical body which is inserted through and fixed on the drive shaft 17. By the rotation of the driving shaft 17, the drive side free roller 26 rotates with the driving roller 15. A pair of drive side free rollers 26 is provided for one driving roller 15. One drive side free roller 26 is respectively disposed at both sides of the driving roller 15 in the axial direction. An outer diameter of the drive side free roller 26 is formed larger than an outer diameter of the driving roller 15. The drive side free roller 26 is fixed on the same driving shaft 17 as the driving roller 15. A part of the drive side free roller 26 is located at a position protruding toward the first frame 20 located above the paper transportation surface 91 including a part of an upper surface of the driving roller 15.

The drive side free roller 26 has a shape in which an outer diameter changes in two stages in an axial direction. The drive side free roller 26 includes a large diameter portion 26*a* and a small diameter portion 26*b*. The small diameter portion 26*b* of each of the drive side free rollers 26 has a diameter approximately the same as an outer diameter of the driving roller 15. In the axial direction, the small diameter portion 26*b* is located closer to the driving roller 15. The entire circumference of the small diameter portion 26*b* is located in the driving roller 15 side rather than the paper transportation surface 91. An outer diameter of the large diameter portion 26*a* is formed larger than the outer diameter of the driving roller 15. A part of the large diameter portion 26*a* is located at a position above the paper transportation surface 91 and protruding toward the first frame 20.

A pair of drive side free rollers 26 for the driving roller 15 has a similar function as one flanged roller having flanges at both ends. More specifically, the driving roller 15 and the small diameter portions 26*b* of a corresponding pair of the drive side free rollers 26 function as a shaft part of the flanged roller. The large diameter portions 26*a* of the drive side free rollers 26 function as a flange of the flanged roller. Therefore, the paper is discharged by the driving roller 15 and the small diameter portions 26*b* of the drive side free rollers 26 and the paper sags in the width direction by the large diameter portions 26*a*. As described above, the paper is also supported and discharged by the large diameter portions 26*a* of the drive side free rollers 26. Therefore, even in case the length of the driving roller 15 in the axial direction is short, a transportation ability of the paper does not lack. Since the paper sags in the width direction by the large diameter portions 26*a*, the paper can be prevented from being curled while being discharged.

The driven side free rollers 27 are located at an opposite side of the drive side free rollers 26 with respect to the paper transportation surface 91 and located above the paper transportation surface 91. As shown in FIG. 2, an axial center of the pressure roller 16 and an axial center of the driven side free roller 27 are displaced slightly. With respect to the paper transportation surface 91, the pressure rollers 16 and the driven side free rollers 27 are located at the same side. Each of the driven side free rollers 27 is supported rotatably by a bearing 28. The bearing 28 is supported by the first frame 20 via a leaf spring 29, which is an urging unit. Under a state in which an external force is not acting upon the driven side free rollers 27, the driven side free rollers 27 are disposed so that a part of each of the driven side free rollers 27 is located in the second frame 30 side rather than the paper transportation surface 91 and at a position protruding below the paper transportation surface 91. When the paper passes through the paper transportation surface 91, the driven side free rollers 27 make contact with the paper and the driven side free rollers 27 sag the paper toward the driving shaft 17, in other words, so as to be looped downward. As described above, the paper sags in the width direction by the driven side free rollers 27. Therefore, while discharging the paper, the paper can be prevented from being curled. In this case, by receiving a reactive force, the driven side free rollers 27 oscillate by the elasticity of the lead springs 29. Therefore, the paper is not damaged.

A description will now be given of the prevention of the curl by the cooperation of the drive side free rollers 26 and the driven side free rollers 27. As shown in FIG. 3, the drive side free rollers 26 are located below the paper transportation surface 91 and the driven side free rollers 27 are located above the paper transportation surface 91. Further, the paper transportation surface 91 is a plane including all of the nip parts 92 of the roller pairs 14. In FIG. 3, the paper transportation surface 91 is illustrated by a straight dashed line. Each of the drive side free rollers 26 protrudes upward from below to above the paper transportation surface 91. Each of the driven side free rollers 27 protrudes downward from above to below the paper transportation surface 91. Therefore, the paper discharged through the paper transportation surface 91 sags and is rippled vertically by each of the drive side free rollers 26 and each of the driven side free rollers 27 in the width direction of the paper. Since the paper is discharged under a state in which the paper is rippled in the width direction as described above, the curl of the paper that generated when the toner is fixed onto the paper is corrected at the discharge of the paper.

The generation of the curl can be prevented as described above. However, if the sag of the paper made by each of the drive side free rollers 26 and each of the driven side free rollers 27 is steep, a line may be formed on the paper when the paper is discharged. Therefore, in the discharge roller device 13 of the present embodiment, the driving rollers 15 are formed by an elastic material such as rubber, the pressure rollers 16 and the driven side free rollers 27 are formed by a stiff resin harder than the driving rollers 15, and the drive side free rollers 26 are formed by a material softer than the driving rollers 15. Therefore, the drive side free rollers 26 sag when the drive side free rollers 26 make contact with the paper. As a result, the sag of the paper is not steep and a line is not formed on the paper. The drive side free rollers 26 can be formed by a material more economical than the driving rollers 15. Therefore, compared with a conventional device, there is no increase in the cost of the discharge roller device 13. Furthermore, to enable the drive side free rollers 26 to sag easily, the axial center part, in particular, the large diameter portions 26*a* can be formed hollow.

In the discharge roller device, the mechanism for sagging the paper in the width direction of the paper is not limited to the structure in which the rollers are disposed along the width direction of the paper at the peripheral part of the roller pairs 14. The rollers sandwiching the paper transportation path 90 can be disposed alternately in the width direction of the paper at a position upstream of the roller pairs 14 of the paper transportation path 90. That is, the discharge roller device can be formed to apply a sag to the paper in the width direction of the paper at the downstream of the paper transportation path 90 rather than the fixing device 10 of the heat roller. The positions of the rollers used for applying the sag in the paper transportation direction are not limited.

The invention claimed is:

1. A discharge roller device, comprising:

at least one roller pair, wherein each roller pair includes a driving roller and a pressure roller which is pushed against the driving roller;

at least one first free roller is pushed against said pressure roller, wherein each first free roller is disposed at a side where the driving roller is disposed with respect to a plane including a nip part of the roller pair and a part of the first free roller is located in a pressure roller side of the plane; and at least one second free roller, wherein each second free roller is disposed at a side where the pressure roller is disposed with respect to the plane and a part of the second free roller is located in a driving roller side of the plane.

2. The discharge roller device according to claim 1, wherein the roller pair is provided in a plurality and each roller pair is disposed with a prescribed interval spaced between one another in a width direction.

3. The discharge roller device according to claim 2, further comprising a driving shaft extending in parallel with the width direction, wherein each driving roller is fixed on one common driving shaft.

4. The discharge roller device according to claim 3, wherein the first free roller is provided in a plurality, a pair of first free rollers is provided for one driving roller, and the first free rollers are respectively provided at both sides of the driving roller in an axial direction.

5. The discharge roller device according to claim 3, wherein the first free roller has a shape in which an outer diameter changes in two stages in an axial direction, a small diameter portion of the first free roller has a diameter approximately the same as an outer diameter of the driving roller, and a large diameter portion of the first free roller is formed larger than the outer diameter of the driving roller.

6. The discharge roller device according to claim 3, wherein the second free roller is formed by a stiff resin harder than the driving roller.

7. The discharge roller device according to claim 4, wherein the driving roller is formed by an elastic body, and the first free roller is formed by a material less stiff than the driving roller.

8. The discharge roller device according to claim 5, wherein the small diameter portion is located closer to the driving roller in the axial direction.

9. The discharge roller device according to claim 5, wherein the large diameter portion is hollow.

10. An image forming device, comprising:

a paper transportation path;

an image forming unit which forms a toner image by an electrophotographic process onto a paper transported through the paper transportation path;

a fixing device which includes a heat roller that heats the paper on which the toner image is transferred and a press roller which pressurizes the paper; and a discharge roller device which comprises:

at least one roller pair, wherein each roller pair includes a driving roller and a pressure roller which is pushed against the driving roller;

at least one first free roller is pushed against said pressure roller, wherein each first free roller is disposed at a side where the driving roller is disposed with respect to a plane including a nip part of the roller pair and a part of the first free roller is located in a pressure roller side of the plane; and at least one second free roller, wherein each second free roller is disposed at a side where the pressure roller is disposed with respect to the plane and a part of the second free roller is located in a driving roller side of the plane.

11. The image forming device according to claim 10, wherein the roller pair is provided in a plurality and each roller pair is disposed with a prescribed interval spaced between one another in a width direction.

12. The image forming device according to claim 11, further comprising a driving shaft extending in parallel with the width direction, wherein each driving roller is fixed on one common driving shaft.

13. The image forming device according to claim 12, wherein the first free roller is provided in a plurality, a pair of first free rollers is provided for one driving roller, and the first free rollers are respectively provided at both sides of the driving roller in an axial direction.

14. The image forming device according to claim 12, wherein the first free roller has a shape in which an outer diameter changes in two stages in an axial direction, a small diameter portion of the first free roller has a diameter approximately the same as an outer diameter of the driving roller, and a large diameter portion of the first free roller is formed larger than the outer diameter of the driving roller.

15. The image forming device according to claim 12, wherein the second free roller is formed by a stiff resin harder than the driving roller.

16. The image forming device according to claim 13, wherein the driving roller is formed by an elastic body, and the first free roller is formed by a material less stiff than the driving roller.

17. The image forming device according to claim 14, wherein the small diameter portion is located closer to the driving roller in the axial direction.

18. The image forming device according to claim 14, wherein the large diameter portion is hollow.

19. A method for manufacturing a discharge roller device, comprising:

forming at least one roller pair having a driving roller and a pressure roller;

pushing the pressure roller against the driving roller;

pushing each first free roller against the pressure roller; disposing each first free roller at a side where the driving roller is disposed with respect to a plane including a nip part of the roller pair;

positioning a part of the first free roller in a pressure roller side of the plane;

disposing each second free roller at a side where the pressure roller is disposed with respect to the plane; and positioning a part of the second free roller in the driving roller side of the plane.

20. The method for manufacturing a discharge roller device according to claim 19, further comprising:

providing a plurality of roller pairs; and disposing each roller pair with a prescribed interval spaced between one another in a width direction.

* * * * *